US005681364A

United States Patent [19]

Fortune

[11] Patent Number: 5,681,364

[45] Date of Patent: Oct. 28, 1997

[54] ROTATING ELEMENT FUME COLLECTION APPARATUS

[76] Inventor: William S. Fortune, 29866 Cuthbert Rd., Malibu, Calif. 90265

[21] Appl. No.: 510,903

[22] Filed: Aug. 3, 1995

[51] Int. Cl.[6] ..... B01D 33/15

[52] U.S. Cl. ..... 55/400; 55/467; 95/277; 416/146 R

[58] Field of Search ..... 55/400, 467, 473; 95/268, 277; 416/62, 146 R

[56] References Cited

U.S. PATENT DOCUMENTS

| | | | |
|---|---|---|---|
| 2,681,761 | 6/1954 | Schlumbohm | 55/400 |
| 2,910,223 | 10/1959 | Schlumbohm | 55/400 |
| 3,018,896 | 1/1962 | Gewiss | 55/400 |
| 3,123,286 | 3/1964 | Abbott | 55/400 |
| 3,128,940 | 4/1964 | McDonald | 55/400 |
| 3,590,629 | 7/1971 | Courbon | 55/400 |
| 3,765,155 | 10/1973 | Courbon | 55/400 |
| 4,450,756 | 5/1984 | Kling | 55/400 |
| 4,676,721 | 6/1987 | Hardee | 55/400 |

FOREIGN PATENT DOCUMENTS

| | | | |
|---|---|---|---|
| 0196337 | 10/1986 | European Pat. Off. | 55/400 |
| 2505125 | 8/1976 | Germany | 55/400 |
| 2901448 | 7/1979 | Germany | 55/400 |
| 1305374 | 1/1973 | United Kingdom | 55/400 |

*Primary Examiner*—C. Scott Bushey
*Attorney, Agent, or Firm*—Daniel T. Anderson

[57] ABSTRACT

An air filtering, fume collecting mechanism is disclosed in which the contaminated air is drawn by a fan through a filter element which spins transversely across the flow of air being drawn by the fan. The filter element may be a disc removeably mounted on the hub of the fan blade assembly or it may be shaped to function as the impeller itself.

1 Claim, 4 Drawing Sheets

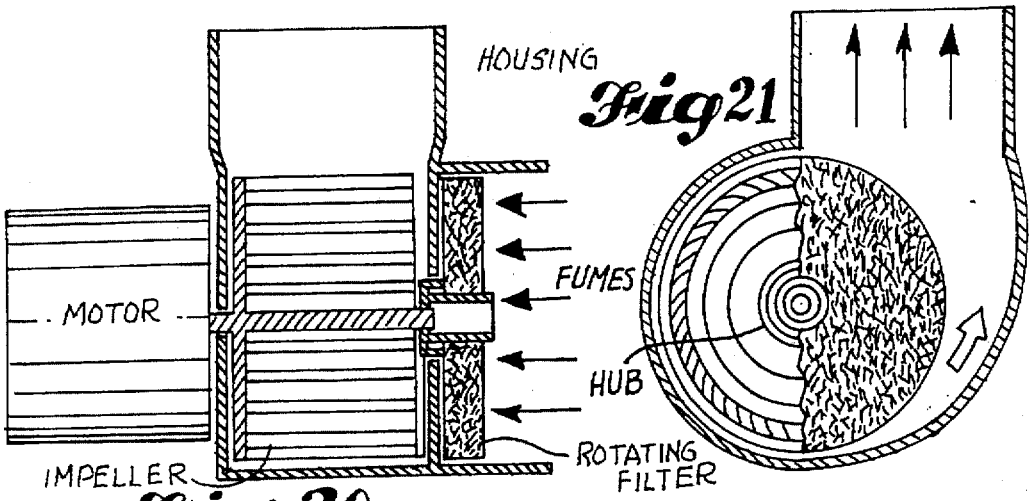
Fig. 21
Fig. 20
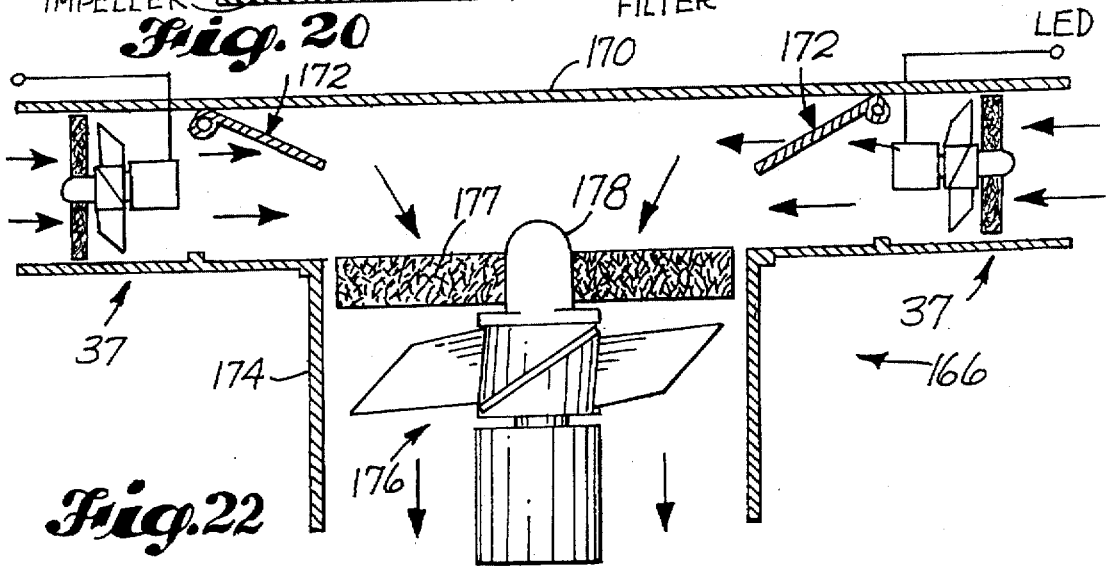
Fig. 22
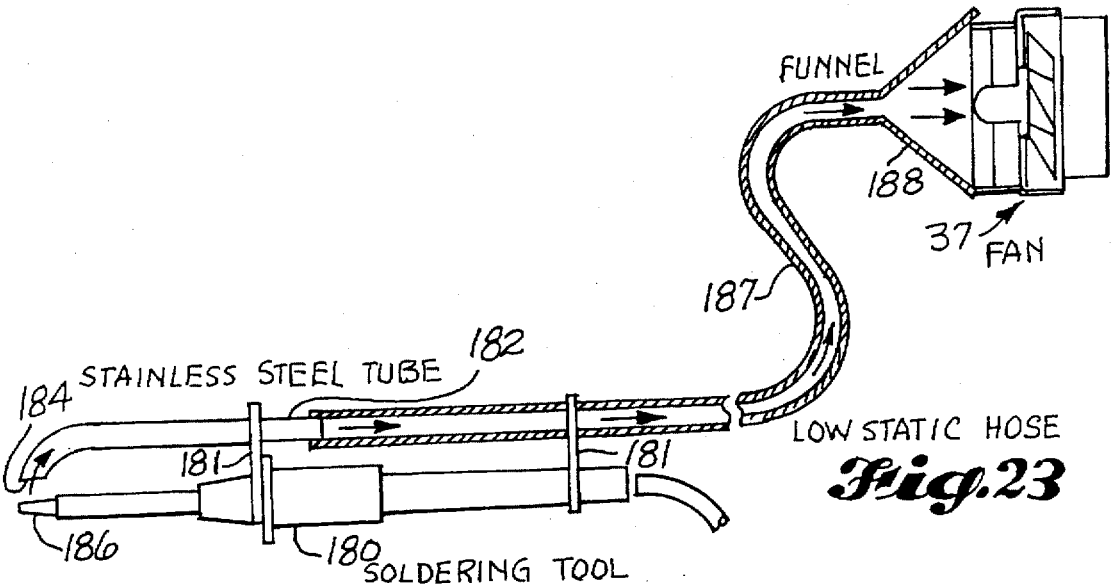
Fig. 23

ROTATING ELEMENT FUME COLLECTION APPARATUS

BACKGROUND OF THE INVENTION

This invention relates generally to environmental air filtration systems and more particularly to mechanical fan or blower mechanisms for drawing contaminated air through a collecting filter.

Although the invention finds particularly advantageous application in the field of soldering and desoldering operations and, in the cause of brevity and clarity most of the discussion below of examples and techniques of utilization relates thereto, the advantages for the invention in many other fields will be equally manifest wherever localized air contamination is a problem for the health or comfort of an operator or technician or where sensitive apparatus cannot tolerate certain environmental contaminates.

Practical approaches to this general problem in the prior art have included small electric fans and blowers which blow or draw air away from the working area or the contaminant source and disperse it into the more general environment. An improvement in this approach is to draw the contaminated air through a filter to collect particulate or precipitate materials from the fume laden air.

Although the former approach may be useful, or better than nothing, its limitations and disadvantages are readily apparent. The limitations of the latter approach are its fan noise required to be adequately effective and the quick saturation of the filter medium or the useful portions thereof. In this latter regard, it has been noted that a filter placed in front of a drawing fan does not collect the contaminant material evenly over its surface: rather, because of the complex air flow pattern through the fan impellers, a blotchy distribution of fume precipitate and particulate matter results in an effective utilization of only a small proportion of the filter area causing those portions to saturate and quickly become ineffective.

It is an object of the present invention to provide an air filtration, fume collection system which is not limited by these and other disadvantages of the prior art.

It is another object to provide such apparatus which fully utilizes the available area of the filter medium.

It is another object to provide such apparatus which is quiet in operation, simple and easy to use and maintain, and inexpensive in its manufacture and maintenance.

It is another object to provide such apparatus which may have a moistened filter medium and in which the "moisture" may odorize or deodorize its treated air.

It is another object to provide such apparatus which is integrated into a complete solder-desolder station to clear the breathing environment of the technician-operator.

It is another object to provide such apparatus which constitutes a general system to create separate, multiple areas of filtered air as in a laboratory or plant having a number of work stations.

SUMMARY OF THE INVENTION

Briefly these objects are achieved in several different embodiments in which the filter element is dynamic in that it is provided with a significant surface velocity transverse to the flow of air drawn by an electric fan or the like. In a simplified version of a preferred embodiment, a filter disc is removeably mounted on the hub of the blade assembly of a filter fan. As so disposed, the filter is axially close to the blades and may circumscribe a circle substantially equal therewith.

In operation, the filter thusly spinning transversely in the column of air drawn by the fan is very significantly more effective in treating the air passing through it: its transverse component of velocity causes exposure of more of its internal surface to the air; and its motion assures a distribution of the collected particulate and precipitant material over all its surface areas.

IN THE DRAWING

FIG. 20 is a side view of a squirrel cage, rotating element example of the invention;

FIG. 21 is a frontal view, partially broken away, thereof;

FIG. 22 is a schematic view of a portion of a central air filtering system example of the invention; and FIG. 23 is a schematic view of an alternative soldering station example of the invention.

DETAILED DESCRIPTION OF PREFERRED EMBODIMENT

Figure 1:
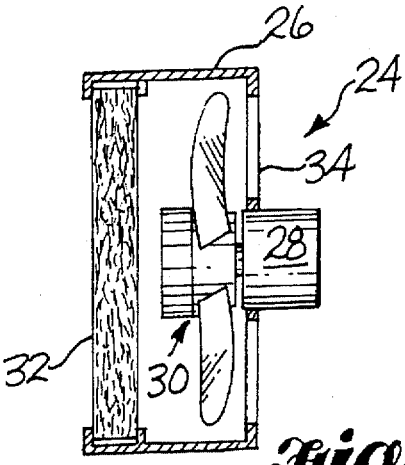
Fig.1 PRIOR ART
FIG. 1 is a side elevational view, partly in section, illustrating a typical prior art filter fan.

The prior art filter fan 24 illustrated in FIG. 1 includes a housing 26 which supports a motor 28 and a fan assembly 30. The motor and fan are of the character, when energized, to draw air into the housing 26 through a removeably supported filter element 32 and rearwardly out through a grill structure 34.

Figure 2:
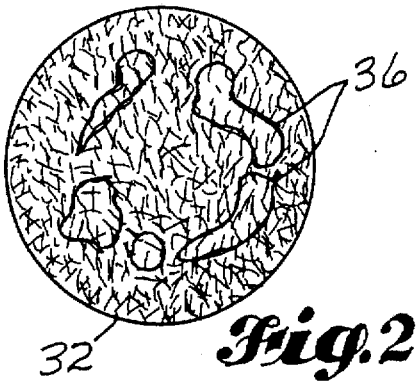
FIG. 2 is a frontal view of its filter element after use.

In FIG. 2, the irregular areas 36 of deposited material represent the typically uneven and inefficient utilization of the filter element in that where the complex flow of air tends to concentrate as it is drawn through the filter, the filter becomes saturated necessitating its cleaning or replacing even though the remainder of the filter surfaces could otherwise still be effective.

Figure 3:
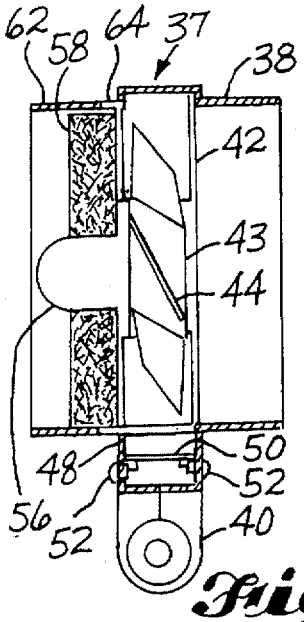
FIG. 3 is a side elevational view, partly in section of an example of a rotating element fume collection or filter fan embodying the principles of the present invention.
Figure 4:
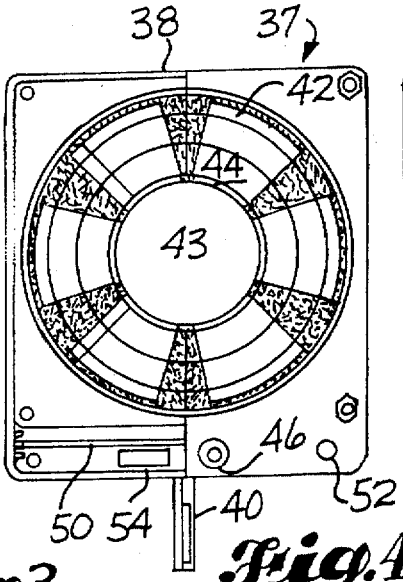
FIG. 4 is a rear view thereof, similarly partially cut away.
Figure 5:
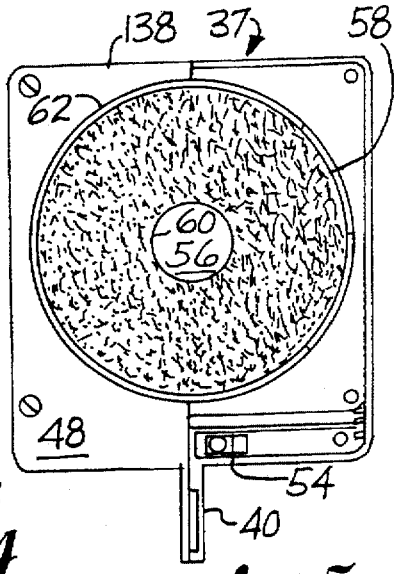
FIG. 5 is a similar frontal view thereof.
Figure 6:
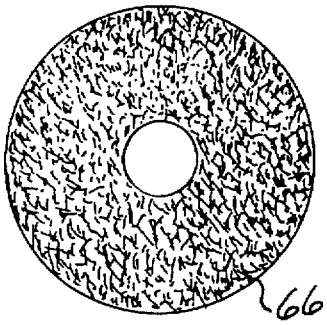
FIG. 6 is a frontal view of an example of the filter element of the apparatus of FIG. 3.

The example of the invention illustrated in FIGS. 3, 4 and 5 includes a filter-fume collector 37 having a fan housing 38 having a swivel mounting bracket 40 at its base and a grillwork 42 covering the rear, output end of the filter-fume collector 37. A motorized fan 43 is supported within the housing 38, by in the example, the grillwork 42 and includes a set of impeller blades 44. A power jack 46 is disposed in the front cover panel 48 of the housing and a circuit board 50 is supported therewithin to which are coupled pilot lamps 52 and control circuitry 54 which may provide manual or automatic control functions for the motorized fan 43.

Projecting axially forwardly from the motorized fan is a large filter retainer hub 56 about which a thick disc filter element 58 is removeably supported. The element 58 is provided with a central bore 60 which is smaller in diameter than the hub 56 whereby it may be readily pressed on or off as desired. The disc thickeness and physical character of the filter element may typically be a low density, open-cell soft rigid foam chosen from many conventional filter materials for the operator's particular application. In each selected such case, however, the disc is flexible, radially compressible for satisfactorily gripping the retaining hub, very low in mass and inertia, and safe with respect to any risk of operator injury.

For its protection from inadvertent touching of the filter as well as for maximum aerodynamic effectiveness, the filter disc element 58 is disposed within a cylindrical shroud 62 extending forwardly concentrically over the retaining hub 56. Experimentation has determined that a set of circumferential foramenations 64 about the rear periphery of the shroud 62 may further improve the overall effectiveness of the filter-fume collector 37.

Figure 7:
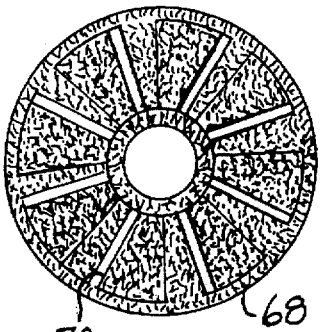
FIG. 7 is a frontal view of an example of a combination filter element and impeller unit.

As implied in the frontal view of the filter element 58 in FIG. 5, the distribution of collected particulate and precipitate material over the surface of the filter is relatively uniform. In addition to such maximum utilization of its frontal surface, the rapid rotation of the disc and its consequent transverse sweeping of the air stream causes a significantly improved utilization of the interior surfaces of the filter material as well. In FIGS. 6, 7, 8 and 9 different examples of the physical configuration of the filter element are illustrated. The example of the filter element 66 of FIG. 6 may be like the filter element 58 with, however, a reduced thickness toward its periphery as shown by the side view of FIG. 9. In FIG. 7, the filter element 68 is shown formed or cut to include in its configuration an intrinsic set of air impellers 70. These impellers, formed monolithically with the filter material, may replace the rigid blades such as the blades 44 of a fan-motor combination or they may be used to function in cooperation therewith.

Figure 8:
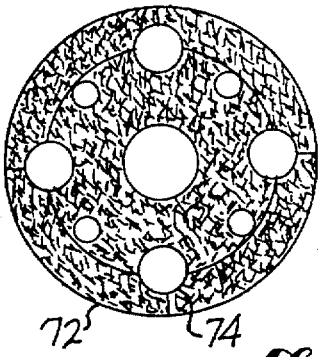
FIG. 8 is a frontal view of an alternative example of a filter element.
Figure 9:
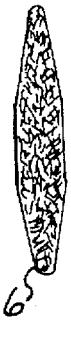
FIG. 9 is a side view illustrating an alternative shape for the preceding filter elements.

In FIG. 8 a foramenated filter disc element 72 having a pattern of openings 74 therethrough illustrates the versatility of the invention in adapting a given filter material to form a filter element particularly advantageous for a specific application. For a given thickness of the filter stock material, the air flow volume, velocity, and other parameters may be adjusted by the number, size, and placement of such openings 74. Again, because of the rapid transverse sweeping effect of the spinning element, the contaminated air is impacted by the interior edges of the opening 74 and is thereby filtered notwithstanding the apparently freely open foramens.

Figure 10:
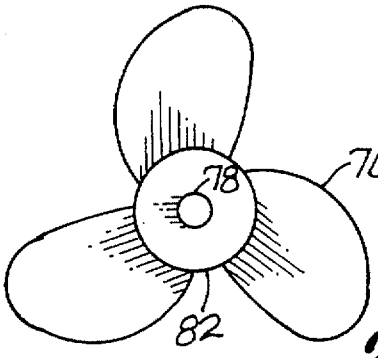
FIG. 10 is a frontal view of a combination filter element impeller unit.
Figure 11:
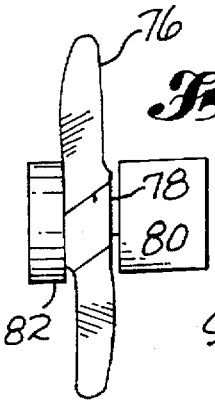
FIG. 11 is a side view thereof.

In FIGS. 10 and 11 another example of the invention is illustrated in which the filter material is utilized to form the impeller blades of the fan. In this case a set of blades 76 are formed or cut monolithically with a central portion having a retaining bore which snug-fits over the hub 78 of a fan motor 80. An additional, retaining disc 82 may be provided as desired to further secure the impeller retention and its stability.

Figure 12:
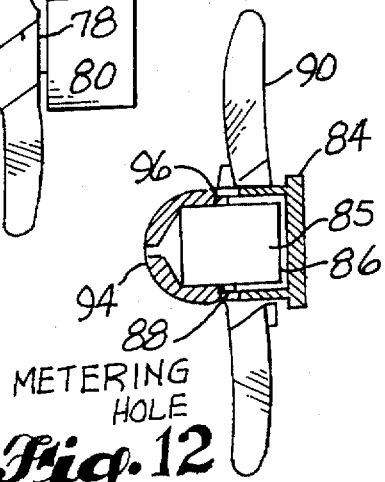
FIG. 12 is a similar view of an alternative example thereof.

FIG. 12 illustrates an example of the invention in which a hollow hub 84 is essentially filled with a liquid 85 retained in a matrix material such as a sponge 86. The liquid is dispensed through metering holes 88 by centrifugal action when the filter impeller 90 is spinning. The fluid 92 may be selected to aid in the collecting action of the filter material and it may incorporate odorizing or deodorizing agents as desired. Access to the interior of the hollow hub 84 is provided by a vented snap-on cap 94 retained by a sealing o-ring 96.

Figure 13:
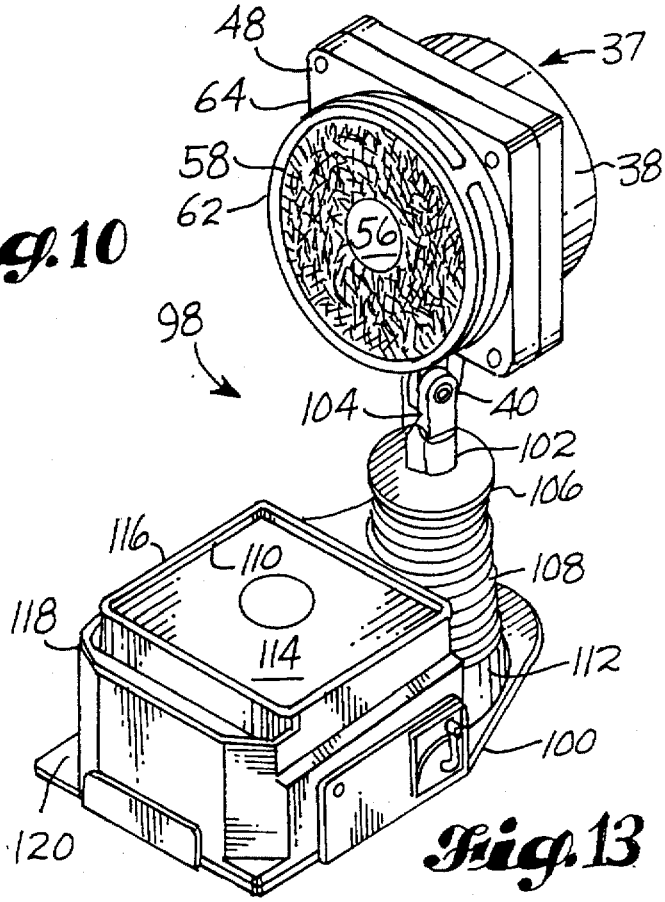
FIG. 13 is a perspective view of an integrated solder-desolder station embodying a rotating element fume collector apparatus of the invention.

In FIG. 13, a complete solder-desolder station 98 embodiment is illustrated which in this example incorporates the filter-fume collector 37 of FIGS. 3, 4, and 5. In addition to those features described in connection with those earlier figures, the station 98 includes a base 100 upon which is mounted a vertical column 102 at the top of which is a swivel mount 104 to receive the mounting bracket 40 of the collector 37. A number of rolls 106, 108 of different types of solder 110, 112, respectively are shown supported on the column 102 in a free strand dispensing mode as indicated. Also mounted on the base 100 is a wet-sponge 114 in a removable tray 116 for soldering tip cleaning, a shelf tray 118 for holding spare soldering tips or other parts, and a compartment 120 below the tray 116 for holding other parts and supplies.

Figure 14:
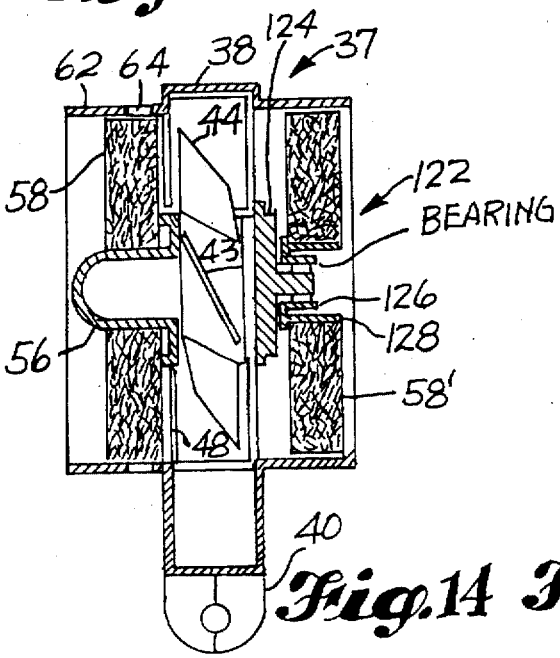
FIG. 14 is a side elevational view, partly in section illustrating a two-stage example of the invention.

The example of the invention shown in FIG. 14 may, for clarity, be considered to be identical to that shown in FIGS. 3, 4, and 5 except that a second stage filter assembly 122 is coupled to the rear, output portion of the filter-fume collector 37'. The assembly 122 includes a fixed hub 124 mounted on the housing 38 concertically with the axis of the motorized fan 43 and upon which is mounted, in turn, a free-wheeling bearing assembly 126 carrying a second hub 128 for a second filter element 58'.

In this example, the rear, second filter element 58' spins freely driven by the rotational velocity component of the column of air driven by the powered fan. Alternatively, the hubs 124 and 128 may be fixed to the shaft of the motorized fan whereby the second filter element 58' is also directly power driven thereby.

Figure 15:
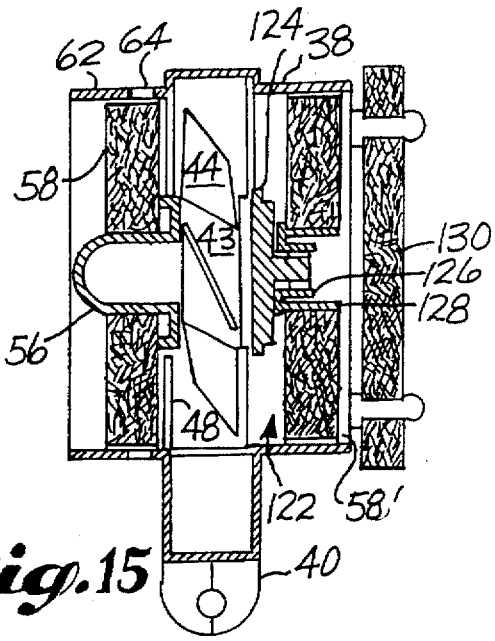
FIG. 15 is a similar view of a three-step example of the invention.

The example of FIG. 15 may be considered to be identical to that of FIG. 14 in all respects except that a fixed, third stage filter element (130) is shown removably mounted on the housing 38 and disposed across the column of air being filtered by the filter elements 58 and 58' disposed upstream thereof.

Figure 16:
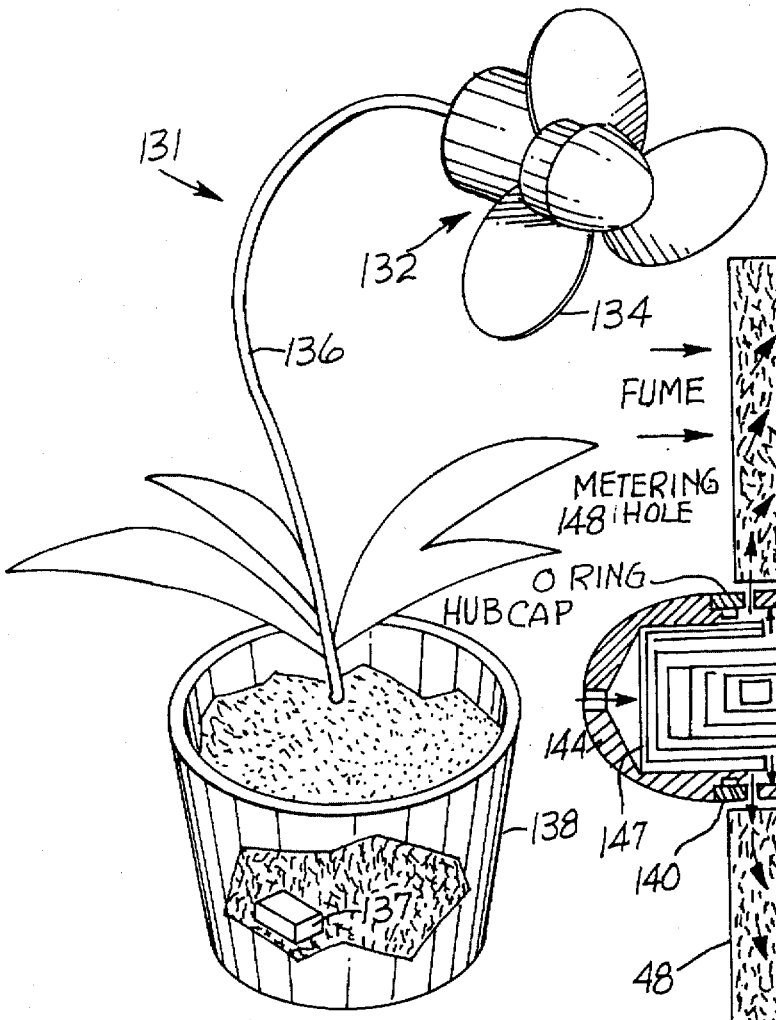
FIG. 16 is a perspective view of a decorative example of a rotating element fume collector apparatus of the invention.

In FIG. 16 a decorative air filtering apparatus is shown which essentially incorporates the component features of the invention as illustrated in FIGS. 10, 11, and 12. A simulated flower assembly 131 includes a motorized fan 132 the impeller blades 134 of which are formed of or cut from a selected filter material. In its simulation of a flowering plant, the filter-fan assembly is supported on a moldable, hollow stem 136 which carries electrical conductors from a battery 137 or other power supply housed in the base 138. The filtering may be controlled in speed or timing by controls in the power supply 137. As in the example of FIG. 12, the "petals" of the assembly may be centrifugally wetted with a desired fragrance.

Figure 17:
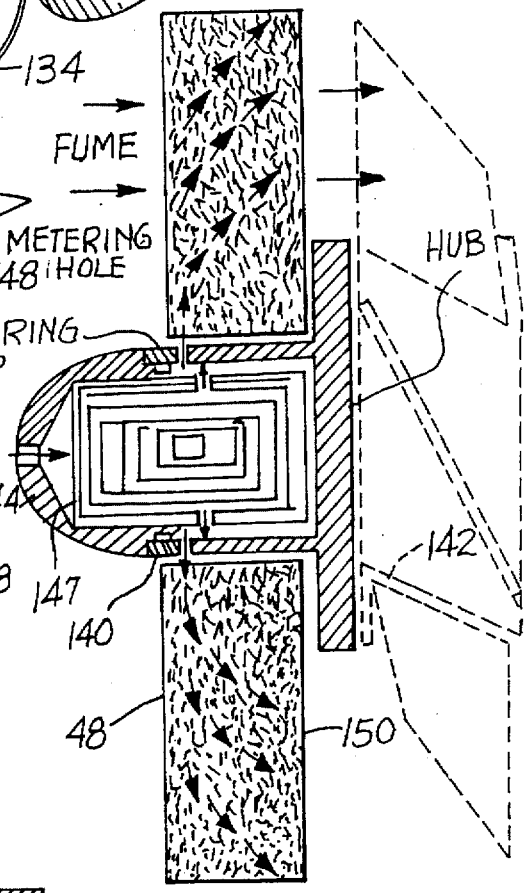
FIG. 17 is a cross-sectional view of a portion of an alternative example of the invention.

In FIG. 17 a further example of a wetted filter element is shown which includes a hollow hub 140 concentrically fixed to the blade assembly 142 of a motorized fan. The hub is fitted with a centrally vented removeable cap 144 which is sealed with an o-ring 146. Again, the interior of the hub may be filled with a moisture retaining matrix material 147 saturated with a desired liquid which may be metered out into the surrounding filter element 58 through the motoring holes 148, the flow path thereof being indicated by the arrows 150.

Figure 18:
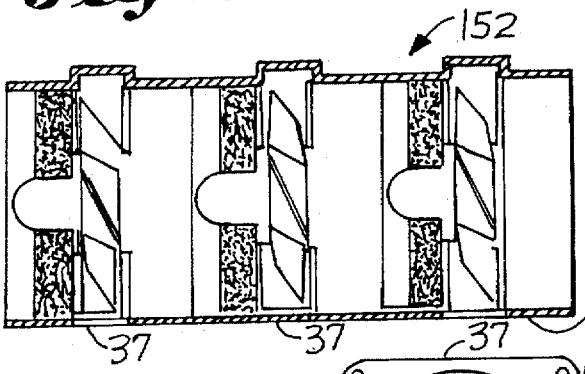
FIG. 18 is a sectional view illustrating an alternative type of multiple stage, in series example of the invention.
Figure 19:
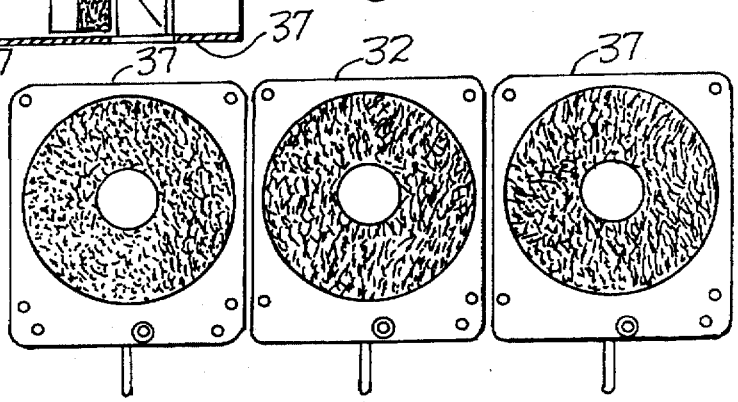
FIG. 19 is a frontal view of an array of fume collectors of the invention arranged in a parallel configuration.

Referring to FIG. 18, a plurality of filter-fume collectors 37 are shown coupled in a series 152 to provide additional or more thorough air filtering when desired. Similarly, FIG. 19 illustrates a like plurality of filter-fume collectors 37 arranged in a parallel array 154, thusly indicating that such smaller units may be modularly configured to provide a desired optimum filtering operation.

In FIGS. 20 and 21, a squirrel cage combination of the invention is shown. An essentially conventional squirrel cage blower 155 including a housing 156, a motor 158, and an impeller 160 is fitted with a filter retaining hub 162 for supporting a spinning filter element 58 across the input mouth 164 of the blower 155.

Referring to FIG. 22 a central filtering system 166 is shown which includes a network of filter-fume collectors 37 coupled to a large central filter fan unit 168 by a duct system 170. Immediately downstream from each collector 37 is a check value 172 so that fumes drawn in can be discharged only through the central collector duct 174 within which is mounted the large fan motor unit 168 having in this example a large spinning filter 177 removeably mounted on its fan hub 178.

In operation, the large central fan motor unit may be selectively energized: when not energized, all the check values 172 will be closed except those behind an energized filter-fume collector 37. If the large central unit is energized and a particular one, or more, of the collectors 37 are not energized, its, or their, respective check valves will nevertheless open and their fans and filters will rotate and function due to the flow of air therethrough driven by the central unit.

In FIG. 23, a soldering station combination according to the present invention is illustrated in which a soldering tool 180 is fitted by mounting brackets 181 with a fume removal tube 182 having an inlet opening 184 disposed contiguously to the soldering tip 186 of the tool 180. The inlet and fume removal tube are coupled by a flexible hose 187 to a funnel-like outlet 188 mounted in air flow communication with a filter-fume collector 37 as shown schematically in the figure.

In operation, when toxic or noxious fumes are being generated at the soldering tip 186, the operator may energize the collector 37 to cause a substantially instantaneous removal of the fumes from his working environment. Alternatively, and in all the previous examples as well, the collector unit or units may be energized by conventional fume sensors such as photo-electric or ionization chamber means.

There have thus been disclosed and described a number of examples of a rotating element filter-fume collector system which exhibit the advantages and achieve the objects set forth hereinabove. It is intended, however, that the scope of the invention is determined by the following claims and not by these particular examples.

I claim:

1. Air filter apparatus comprising:

fan support structure;

air driving rotating filter means carried by said fan support structure;

motor means connected to said rotating filter means for rotationally driving said filter means;

elements for axially driving pollutant laden ambient air and being formed of a substantially rigid, self supporting, monolithic, thick disc of filter foam material through which a substantial portion of the driven air may pass in a pollutant filtering relation therewith and said elements each being a radially extending slot having an axial slope for driving said air.

* * * * *